US009646463B2

(12) United States Patent
Hsu

(10) Patent No.: US 9,646,463 B2
(45) Date of Patent: May 9, 2017

(54) INTERFACE APPARATUS AND METHOD FOR PROMPTING HOT GAMES

(76) Inventor: Tien-Shu Hsu, Taichung (TW)

( * ) Notice: Subject to any disclaimer, the term of this patent is extended or adjusted under 35 U.S.C. 154(b) by 440 days.

(21) Appl. No.: 13/307,501

(22) Filed: Nov. 30, 2011

(65) Prior Publication Data

US 2013/0137519 A1 May 30, 2013

(51) Int. Cl.
*G07F 17/32* (2006.01)

(52) U.S. Cl.
CPC ..... *G07F 17/326* (2013.01); *G07F 17/3267* (2013.01)

(58) Field of Classification Search
CPC ..... G07F 17/326
USPC ..... 463/25, 42
See application file for complete search history.

(56) References Cited

U.S. PATENT DOCUMENTS 6,217,448 B1 * 4/2001 Olsen ..... G07F 17/32 463/25
2006/0121972 A1 * 6/2006 Walker ..... G07F 17/32 463/16
2007/0243934 A1 * 10/2007 Little et al. ..... 463/40
2008/0146344 A1 * 6/2008 Rowe et al. ..... 463/42
2009/0124327 A1 * 5/2009 Caputo et al. ..... 463/20
2009/0131145 A1 * 5/2009 Aoki et al. ..... 463/20
2011/0183746 A1 * 7/2011 Englman et al. ..... 463/25

* cited by examiner

*Primary Examiner* — Dmitry Suhol
*Assistant Examiner* — Ankit Doshi
(74) *Attorney, Agent, or Firm* — Muncy, Geissler, Olds & Lowe, P.C.

(57) ABSTRACT

An apparatus incorporated with a game operation interface to offer selection of anyone of multiple game stations to play a game includes a judgment unit, a control unit and a prompt unit. The judgment unit is connected to the game stations and monitors historical game results of the game stations. The control unit is connected to the judgment unit and prompt unit. The prompt unit includes a plurality of notification elements corresponding to the game stations and is incorporated with the game operation interface. When the judgment unit detects that one of the historical game results of the game stations has met a preset condition, a control signal is generated. The control unit controls the prompt unit to make the notification elements to generate a notification signal to inform players whether a hot game is generated on the game stations.

18 Claims, 8 Drawing Sheets

INTERFACE APPARATUS AND METHOD FOR PROMPTING HOT GAMES

FIELD OF THE INVENTION

The present invention relates to a game station and particularly to an integrated operation interface for a plurality of game stations.

BACKGROUND OF THE INVENTION

A conventional game operation interface 1, referring to FIG. 1, generally can be linked to a plurality of game stations 2, such as Baccarat, dice games, roulette and the like. Players can maneuver the game operation interface 1 to select a desired game station 2 to place bets directly without environmental restrictions. Each game station 2 allows more players to participate and utilization is higher and can increase total business revenue.

The players, through merely a single game operation interface 1, can place bets on games of different game stations 2 at remote sites, and can switch display anytime via the game operation interface 1 to play on different game stations 2 without wasting time going physically to another game station 2. The players can save a lot of time and devote more times to play games. Utilization of the game stations 2 also increases.

The general players usually have a habit of following and betting on hot games. A hot game means that the historical game result of the game station 2 meets a certain condition to motivate players to join and place bets. Take Baccarat as an example, when consecutive winning games of the banker or player has reached certain times (such as five times or more), it may be called a hot game. For such a game many players want to participate and place bets until the consecutive winning times end.

However, when the players play games through the game operation interface 1, aside from the games they are currently playing on the game stations 2, they usually do not know whether a hot game has been generated on other game stations 2. In order to avoid missing the hot game, they have to switch the game stations 2 frequently to see other games that are proceeding.

When the players switch the game stations 2, they have to wait until the start of next round of game to place bets. This causes waste of time, and the actual game playing time of the players decreases. Utilization of the game station 2 also drops.

SUMMARY OF THE INVENTION

The primary object of the present invention is to provide an apparatus capable of prompting hot games to inform players generation of hot games without switching display.

Another object of the invention is to provide a method of prompting hot games to inform players generation of hot games without switching display.

To achieve the foregoing objects the invention provides an interface apparatus and method that can prompt hot games. It is incorporated with a game operation interface. The game operation interface provides selection of playing games on any one of multiple game stations, and includes a judgment unit, a prompt unit and a control unit. The judgment unit is connected to the game stations and monitors historical game results of the game stations. When the judgment unit detects that one of the historical game results of the game stations has met a preset condition and a hot game can be established, it generates a control signal. The prompt unit includes a plurality of notification elements corresponding to the game stations and is incorporated with the game operation interface. The control unit is connected to the judgment unit and prompt unit and receives the control signal to control the prompt unit to make a corresponding notification element to generate a notification signal.

The invention monitors whether the historical game results meet the preset condition, and generates a notification signal when the preset condition is met, and conceals the notification signal when the preset condition is not being met. Hence players, by observing the presence of the notification signal, can be informed whether a hot game meeting a preset condition has been generated.

In short, the invention, through the judgment of the judgment unit, can control the prompt unit via the control unit when any one of the game stations has a hot game established, and make the corresponding notification element to generate the notification signal to notify players. In other words, the invention provides a feature that monitors whether historical game results have met a preset condition and enables the players to be informed that a hot game has been generated without the need of constantly switching the game stations, hence can meet players' requirements and also increase utilization of the game stations.

The foregoing, as well as additional objects, features and advantages of the invention will be more readily apparent from the following detailed description, which proceeds with reference to the accompanying embodiments and drawings. The embodiments serve merely for illustrative purpose and are not the limitations of the invention.

DETAILED DESCRIPTION OF THE PREFERRED EMBODIMENTS

Figure 1:
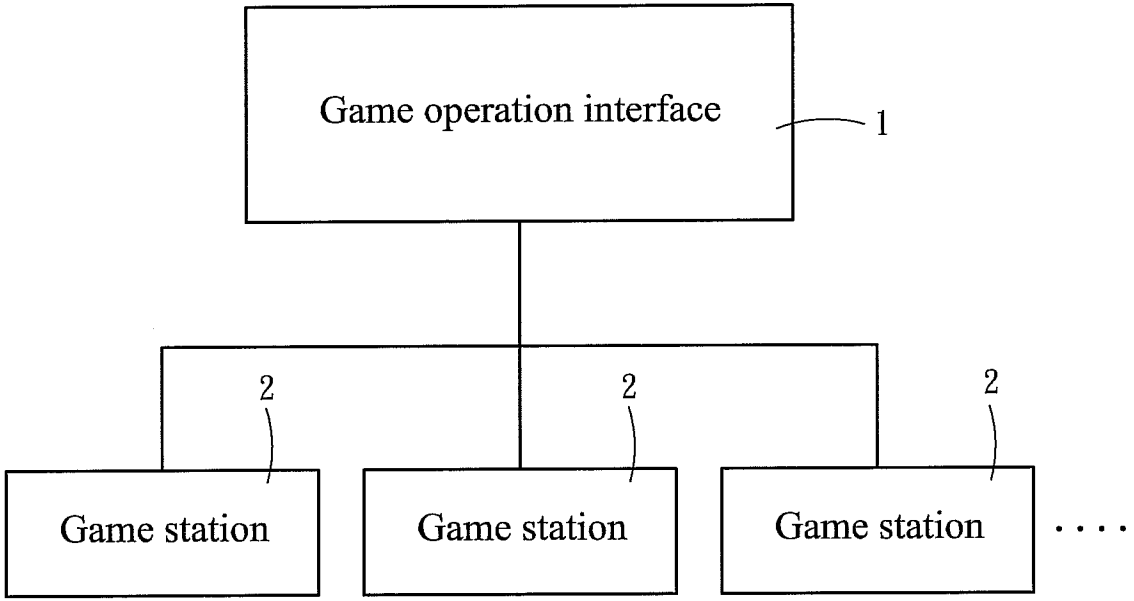
Fig. 1 PRIOR ART
FIG. 1 is a schematic view of a conventional system structure.
Figure 2:
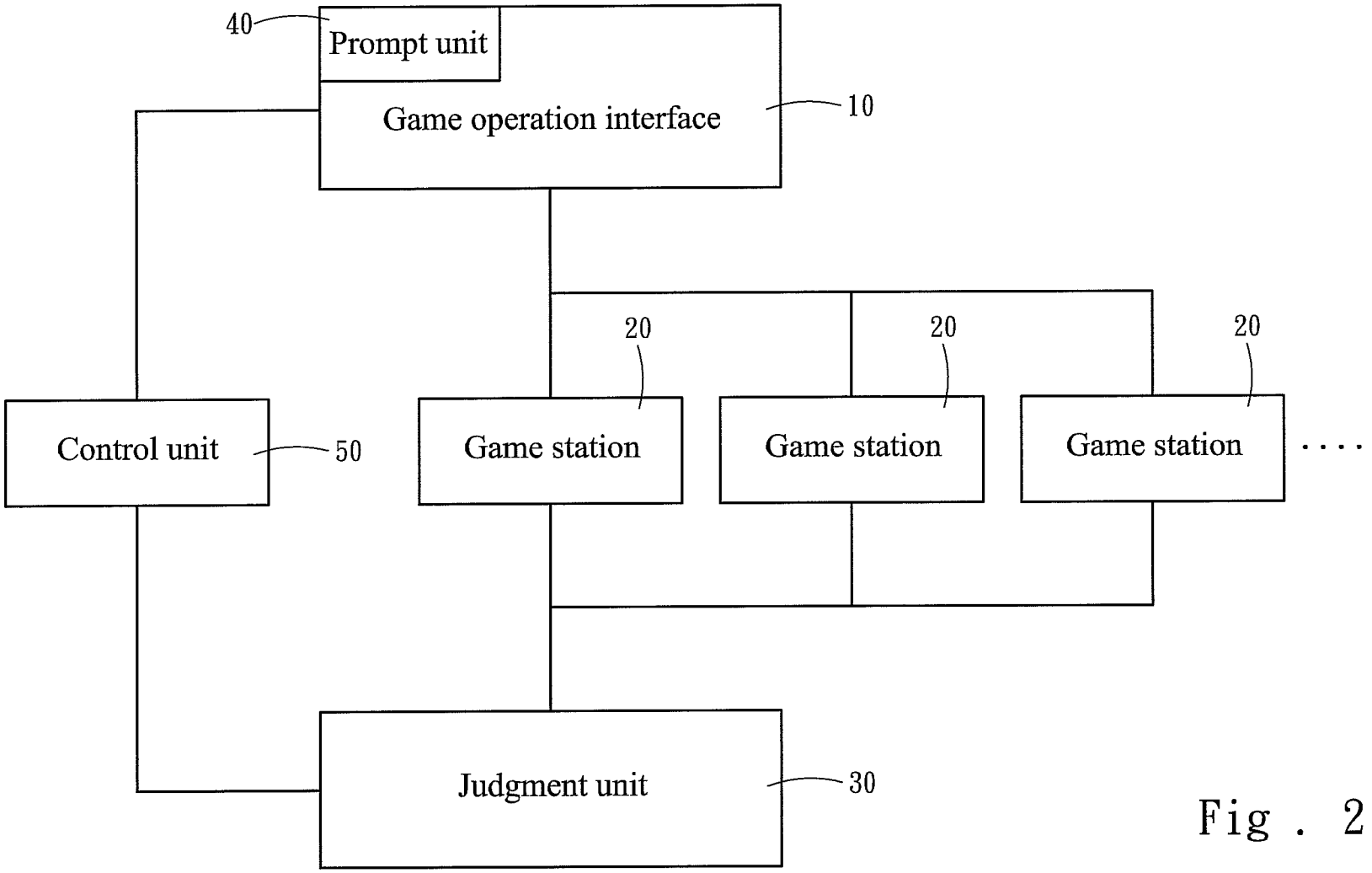
FIG. 2 is a schematic view of the system structure of the invention.
Figure 3:
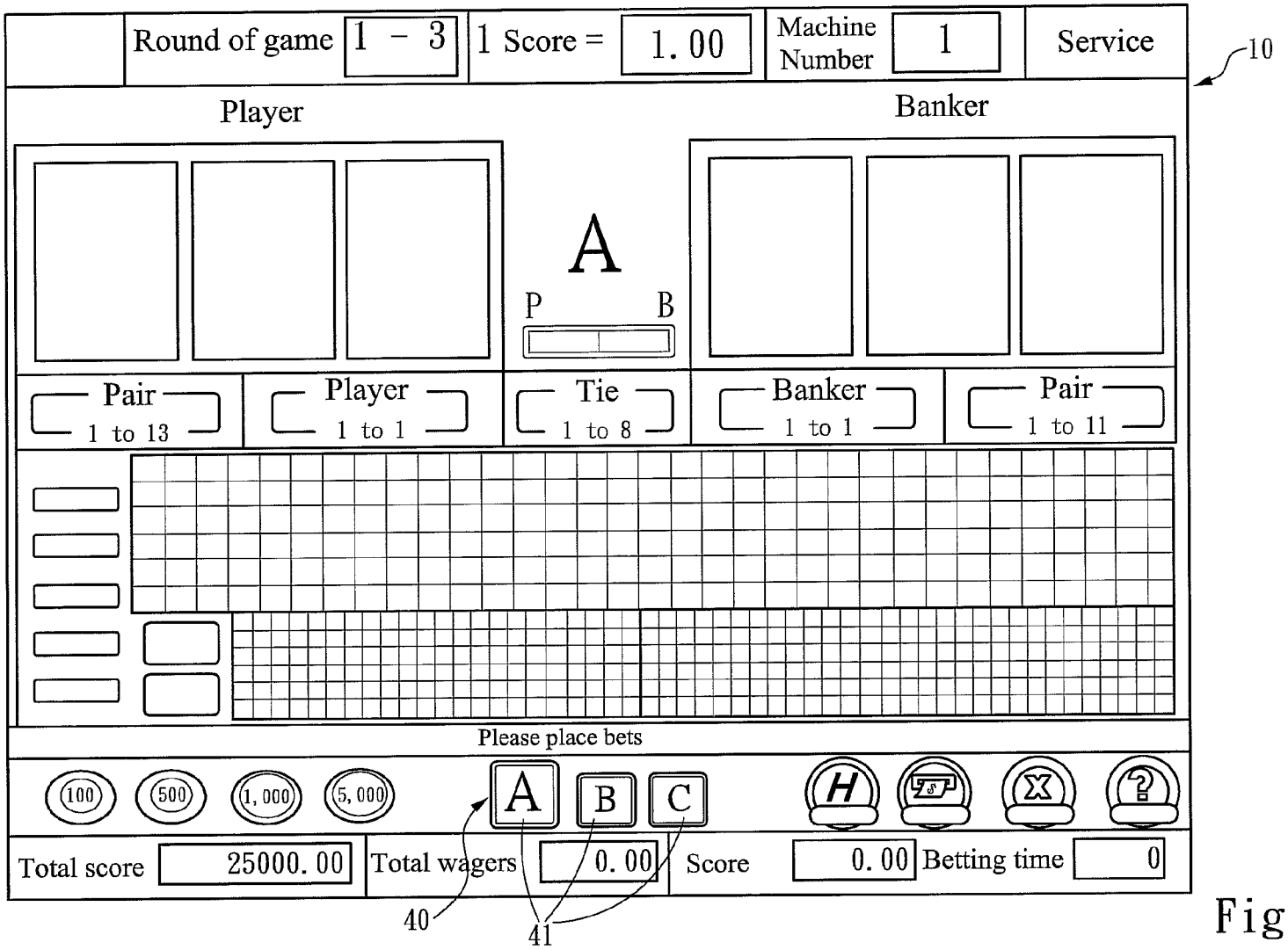
FIG. 3 is a schematic view of an operation display of the invention.

Please referring to FIGS. 2 and 3, the present invention aims to provide an interface apparatus and method capable of prompting hot games. It is incorporated with a game operation interface 10. The game operation interface 10 provides selection of playing games on any one of multiple game stations 20, and includes a judgment unit 30, a prompt unit 40 and a control unit 50. The judgment unit 30 is connected to the game stations 20 and monitors historical game results of the game stations 20.

The game stations 20 can provide same game or different games, such as Baccarat, dice games, roulette, and the like. In this embodiment, Baccarat is taken as an example, but not the limitation. Three game stations 20 are shown in the drawings to facilitate discussion and marked by A, B and C.

The prompt unit 40 includes a plurality of notification elements 41 corresponding to the game stations 20 and is incorporated with the game operation interface 10. The control unit 50 is connected to the judgment unit 30 and prompt unit 40. The judgment unit 30 monitors historical game results of the game stations 20. When the judgment unit 30 detects that one of the historical game results of the game stations 20 has met a preset condition of a hot game, a control signal is generated. The control unit 50 receives the control signal and controls the prompt unit 40 to make the corresponding notification element 41 to generate a notification signal.

It is to be noted that the preset condition is set according to the type of the game stations 20, player's requirements or made by the system. In general, for a Baccarat game, when the house or bettor has won consecutively five times, it can be deemed as a hot game, and the preset condition can be five consecutive wins by the house or bettor.

Figure 4A:
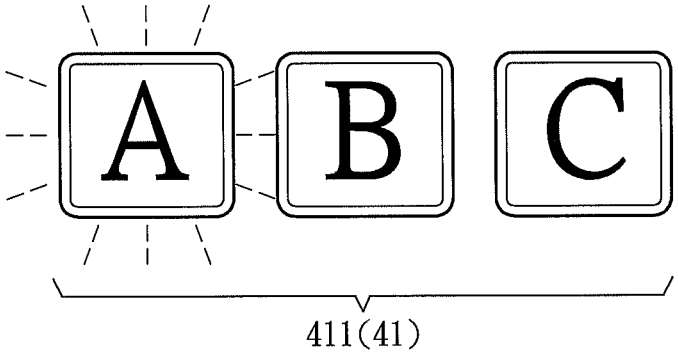
FIGS. 4A through 4D are schematic views of first embodiment through fourth embodiment of notification signals of the invention.

Referring to FIG. 4A, the notification elements 41 can be set according to the onsite environment or player's habit. For instance, the notification elements 41 can be flicker lights 411 which flicker to inform players a hot game is generated. In FIG. 4A a flicker light is represented by the broken lines.

Figure 4B:
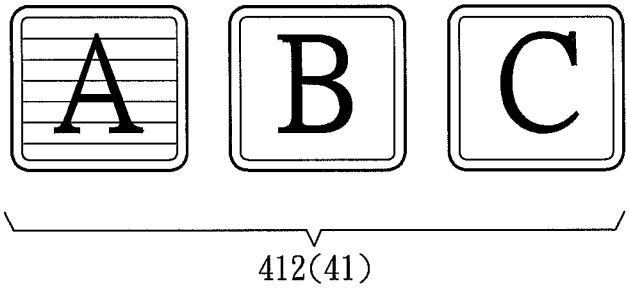

FIG. 4B illustrates another embodiment in which each notification element 41 is a colored light 412 with switchable colors, such as yellow, orange, red and the like. By displaying the color of yellow, orange or red, the popularity of the game station 20 can be indicated. For instance, when the Baccarat game on the game station 20 has consecutive wins with rounds of game just reached the set threshold, yellow light may be shown; with increasing of consecutive winning rounds, the light color may become orange; and finally, become red. Therefore, by observing generation and change of the color of the color light 412 players are informed whether a hot game has been generated. The colored light indicated by sectional lines in FIG. 4B.

Figure 4C:
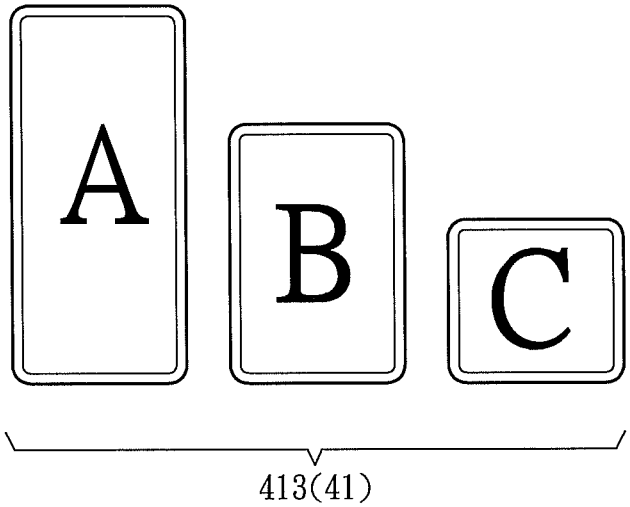

FIG. 4C illustrates yet another embodiment in which the notification element 41 is a changeable icon 413. The icon 413 is an oblong shape with the length corresponding to the popularity of the game station 20. With increasing of consecutive winning frequency, the length of the icon 413 also increases gradually; hence by observing the change of the length of the icon 413 the players are informed whether a hot game has been generated.

Figure 4D:
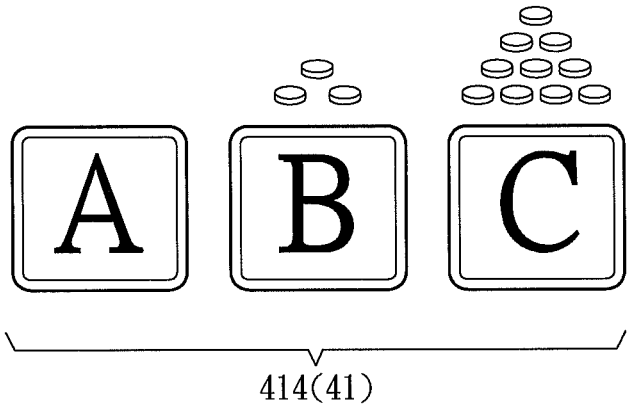

FIG. 4D shows still another embodiment in which the notification element 41 is an animation 414. The quantity of the animation 414 can be changed to indicate the popularity of the game station 20. For instance, stack of the gold coins can be increased gradually to indicate increasing of consecutive winning frequency. Hence by observing the stacking number of the gold coins on the animation 414 the players are informed of the popularity of the game station 20.

Figure 5:
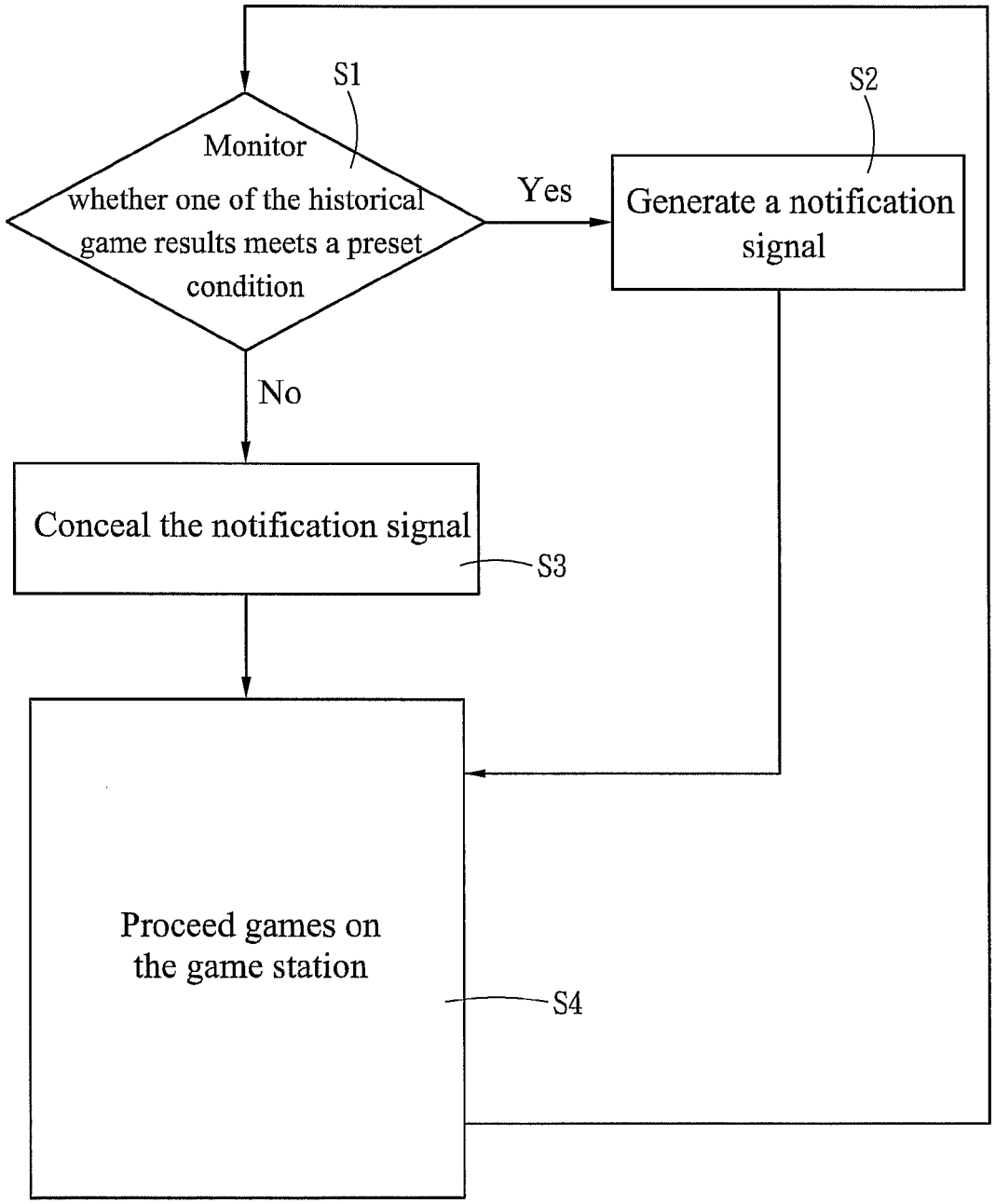
FIG. 5 is a system operation flowchart of the invention.

Please refer to FIG. 5 for the system process flow of the invention. The method according to the invention is adopted for use on a game operation interface 10 which can selectively play games on any of multiple game stations 20 each has registered a historical game result. The process includes steps S1 through S4. Before a game starts on each game station 20, the judgment unit 30 monitors whether the historical game result has met a preset condition, this is step S1: monitor whether historical game results have met a preset condition; and the judgment unit 30 is connected to the game stations 20 to perform the monitor process.

Step S2: if the preset condition is met, generate a notification signal; Step S3: if the preset condition is not met, conceal the notification signal. The prompt unit 40 is incorporated with the game operation interface 10 and includes a plurality of notification elements 41 corresponding to the game stations 20. The notification elements 41 can be activated to generate the notification signal, or be closed down to conceal the notification signal.

Players, by observing the presence of the notification signal, can be informed whether a hot game meeting the preset condition has been generated. Therefore, the players can have knowledge of the hot games.

After the steps S2 and S3, step S4 can be proceeded to play the game on the game station 20. When the step S4 ends, go to step S1 to repeat the process to start another cycle.

As a conclusion, the invention provides the judgment unit 30 to monitor whether historical game results have met a preset condition; if the outcome is positive, generate a notification signal through the notification element 41 to inform players, therefore the players do not have to switch display constantly to be informed generation of a hot game and have more time to place bets, and utilization of the game stations 20 also increases.

What is claimed is:

1. An interface apparatus for prompting hot games being remotely connected with a plurality of game stations to play a game, comprising:

a game operation interface connected to the plurality of game stations for a player to select one of the game stations to play on the game operation interface and display the selected game station;

a judgment unit connected to the game stations to monitor historical game results thereof and generate a control signal when one of the historical game results of the game stations meets a preset condition to become a hot game;

a prompt unit which is installed on the game operation interface and includes a plurality of notification elements corresponding to the plurality of game stations in a one-to-one manner, all of the notification elements for all of the game stations displayed on the game operation interface without changing among the game stations when playing a game; and a control unit which is connected to the judgment unit and the prompt unit and controls the prompt unit upon receiving the control signal to order one of the notification elements corresponding to the game station becoming the hot game to generate a notification signal to make the player know which game station has become the hot game by observing the generation of the corresponding notification signal, wherein the control unit receives the plurality of the control signals corresponding to each of the game stations respectively and orders the notification elements corresponding to the game stations generating the notification signals, which makes the notification elements appear different visual effects according to the different popularity of the game stations and that allows the player to obtain the popularity of each of the game stations at the same game operation interface.

2. The interface apparatus of claim 1, wherein the notification elements are flicker lights.

3. The interface apparatus of claim 1, wherein the notification elements are colored lights of changeable colors.

4. The interface apparatus of claim 3, wherein the colored lights are switchable in yellow, orange and red to sequentially indicate different popularity of the game stations.

5. The interface apparatus of claim 1, wherein the notification elements are changeable icons.

6. The interface apparatus of claim 5, wherein the icons are oblong in shape formed at a length corresponding to the popularity of the game stations.

7. The interface apparatus of claim 1, wherein the notification elements are animations changeable in amount of quantity to indicate the popularity of the game stations.

8. The interface apparatus of claim 1, wherein the judgment unit monitors whether the historical game results meet the preset condition before the game is played on the game stations.

9. The interface apparatus of claim 1, wherein the plurality of game stations provide Baccarat, dice games, or roulette.

10. A method of prompting hot games being employed in an interface apparatus which comprises a game operation interface, a prompt unit installed on the game operation interface, a judgment unit and a control unit connecting the judgment unit to the prompt unit, the game operation interface remotely connected with a plurality of game stations for a player to select one of the game stations to play on the game operation interface and display the selected game station, each of the game stations recording a historical game result, the method comprising the steps of:

S1: using the judgment unit which is connected with the game stations to monitor whether one of the historical game results of the game stations meets a preset condition; proceeding step S2 when the preset condition is met, and proceeding step S3 when the preset condition is not met;

S2: letting the judgment unit generate a control signal and send the control signal to the control unit, the control unit controlling the prompt unit which includes a plurality of notification elements that are corresponding to the plurality of game stations in a one-to-one manner and all of the notification elements for all of the game stations displayed on the game operation interface without changing among the game stations when playing a game upon receiving the control signal, so that one of the notification elements corresponding to the game station become the hot game is controlled by the control unit to generate a notification signal to make the player know which game station has become the hot game by observing the generation of the corresponding notification signal, wherein the control unit receives the plurality of the control signals corresponding to each of the game stations respectively and orders the notification elements corresponding to the game stations generating the notification signals, which makes the notification elements appear different visual effects according to the different popularity of the game stations which allows the player to obtain the popularity of each of the game stations at the same game operation interface;

S3: letting the notification elements conceal the notification signal to make the player know that none of the game stations has become the hot game.

11. The method of claim 10 further including step S4 after the steps S2 and S3 to play the game on the game station, and repeat the step S1 after the step S4 ends.

12. The method of claim 10, wherein the notification elements are flicker lights.

13. The method of claim 10, wherein the notification elements are colored lights of changeable colors.

14. The method of claim 13, wherein the colored lights are switchable in yellow, orange and red to sequentially indicate different popularity of the game stations.

15. The method of claim 10, wherein the notification elements are changeable icons.

16. The method of claim 15, wherein the icons are oblong in shape formed at a length corresponding to the popularity of the game stations.

17. The method of claim 10, wherein the notification elements are animations changeable in amount of quantity to indicate the popularity of the game stations.

18. The method of claim 10, wherein the plurality of game stations provide Baccarat, dice games, or roulette.

* * * * *